US012139180B2

(12) United States Patent
Lindemulder et al.

(10) Patent No.: US 12,139,180 B2
(45) Date of Patent: Nov. 12, 2024

(54) RAILCAR UNCOUPLING LEVER APPARATUS AND METHODS OF USING THE SAME

(71) Applicant: Holland, L.P., Crete, IL (US)

(72) Inventors: Paul Lindemulder, Saint John, IN (US); John B. Brewster, Homewood, IL (US); Christopher D. Roberts, New Lenox, IL (US)

(73) Assignee: Holland, L.P., Crete, IL (US)

( * ) Notice: Subject to any disclaimer, the term of this patent is extended or adjusted under 35 U.S.C. 154(b) by 38 days.

(21) Appl. No.: 17/992,077

(22) Filed: Nov. 22, 2022

(65) Prior Publication Data

US 2023/0159067 A1 May 25, 2023

Related U.S. Application Data

(60) Provisional application No. 63/281,792, filed on Nov. 22, 2021.

(51) Int. Cl.
*B61G 7/02* (2006.01)

(52) U.S. Cl.
CPC ..... *B61G 7/02* (2013.01)

(58) Field of Classification Search
CPC ..... B61G 7/02
See application file for complete search history.

(56) References Cited

U.S. PATENT DOCUMENTS

| | | | | | |
|---|---|---|---|---|---|
| 3,127,997 | A * | 4/1964 | Lahey | B61G 3/08 | 213/166 |
| 3,239,074 | A * | 3/1966 | Boone | B61G 7/02 | 213/219 |
| 3,294,253 | A * | 12/1966 | Manyek | B61G 7/02 | 213/219 |
| 3,814,267 | A * | 6/1974 | Chierici | B61G 7/02 | 213/219 |
| 4,602,717 | A * | 7/1986 | Krzanowsky | B61G 7/02 | 213/162 |
| 5,128,529 | A * | 7/1992 | Nagaoka | G02B 7/32 | 396/106 |
| 7,686,177 | B1 * | 3/2010 | Jackson | B61G 7/02 | 213/166 |
| 2018/0281827 | A1 * | 10/2018 | Maki | B61G 7/02 | |
| 2020/0172127 | A1 * | 6/2020 | Hankinson | B61G 7/02 | |

* cited by examiner

*Primary Examiner* — Daniel D Yabut
(74) *Attorney, Agent, or Firm* — Scherrer Patent & Trademark Law, P.C.; Stephen T. Scherrer; Monique A. Morneault

(57) ABSTRACT

Improved telescoping railcar uncoupling levers have improved bearings that resist damage. Moreover, the uncoupling levers include removable lock lifter linkage hooks. In addition, the uncoupling levers comprise an improved handle loop shape allowing the levers to be more easily installed and/or removed when damaged. Methods of using the same are further provided.

20 Claims, 7 Drawing Sheets

RAILCAR UNCOUPLING LEVER APPARATUS AND METHODS OF USING THE SAME

CROSS-REFERENCE TO RELATED APPLICATIONS

The present invention claims priority to U.S. Prov. Pat. App. No. 63/281,792, titled "Railcar Uncoupling Lever Apparatus and Methods of Using the Same," filed Nov. 22, 2021, which is incorporated herein by reference in its entirety.

TECHNICAL FIELD

The present invention relates to improved telescoping railcar uncoupling levers. Specifically, the uncoupling levers have improved bearings that resist damage. Moreover, the uncoupling levers include removable lock lifter linkage hooks. In addition, the uncoupling levers comprise an improved handle loop shape allowing the levers to be more easily installed and/or removed when damaged. Methods of using the same are further provided.

BACKGROUND

An uncoupling lever is a bar or rod of a specific shape, comprising a handle on one end thereof that is engaged to a bracket on an end of a railcar, a lock lifter linkage hook on a second end thereof that engages the lock lifter linkage of a Janney-type railcar coupler, and an extended, typically telescoping, portion between the first end and the second end thereof. When in use for uncoupling railcars, the handle engaged with the bracket is typically lifted, causing the hook end, engaged with the uncoupling mechanism of the Janney coupler, to rotate causing the Janney coupler to uncouple, causing separation of the railcars. As noted, the uncoupling levers typically have a telescoping extended element between the two ends thereof for precisely engaging the uncoupling lever between the bracket and the uncoupling mechanism of the Janney-type coupler, as different railcars may have different distances between the two.

Users of heretofore known uncoupling levers report that the typical service life of an uncoupling lever is about 18 months to about 3 years before the levers require replacement. In that time, the uncoupling levers may be repaired, typically due to wear and loss of bearing material that is used to allow the elongated portion to telescope. The telescoping portion generally comprises at least two lever arms that slide across the bearing material, either extending or contracting/collapsing the elongated portion to fit the needed distance between the bracket and the uncoupling mechanism of the Janney-type coupler.

Federal Railroad Administration (FRA) rules dictate that if in-track inspections finds that two of the bearings are missing on the side, or more than two bearings are missing overall, then the lever must be replaced before the railcar can be placed back into service. If the railcar is in the repair in place (RIP) track or service shop, and one or more bearings are missing, the lever must be replaced. Missing bearings can lead to the lever jamming when extended or contracted/collapsed due to the friction of the lever arms and subsequent bending of the lever. Bent levers must be replaced before the railcar can be returned to service.

A need, therefore, exists for an improved uncoupling lever apparatus. Specifically, a need exists for an uncoupling lever apparatus having a longer service life than typical heretofore known uncoupling levers. More specifically, a need exists for an uncoupling lever apparatus comprising improved bearings that resist damage, thereby preventing or minimizing bending or damage of the levers during use in the field.

The process of replacing an uncoupling lever typically requires the bracket, which is attached to the railcar, to be removed by torching off the colts holding the bracket to the railcar. The lever is then rotated in a way as to remove the hook end from the lifter linkage of the Janney-type coupler. Oftentimes, this is very difficult due to the narrow fit of the hook end into the uncoupling mechanism of the Janney-type coupler, as well as the relatively small space under the railcar. The new coupler is then positioned in the uncoupling mechanism of the Janney-type coupler, which again is difficult due to positioning and the space constraints, and a new bracket is often placed into the handle and then bolted back onto the railcar.

A need, therefore, exists for an improved uncoupling lever arm that is more easily removed and/or installed onto a railcar. More specifically, a need exists for an improved uncoupling lever arm that allows a user to remove and/or install the same without removal of the bracket from the railcar, thereby saving time and costs when levers require replacement.

SUMMARY OF THE INVENTION

The present invention relates to improved telescoping railcar uncoupling levers. Specifically, the uncoupling levers have improved bearings that resist damage. Moreover, the uncoupling levers include removable lock lifter linkage hooks. In addition, the uncoupling levers comprise an improved handle loop shape allowing the levers to be more easily installed and/or removed when damaged. Methods of using the same are further provided.

To this end, in an embodiment of the present invention, a railcar uncoupling lever apparatus is provided. The railcar uncoupling lever comprises: a telescoping bar having a first end and a second end; a handle on the first end of the telescoping bar; a hook on the second end of the telescoping bar, wherein the handle is configured to thread through a bracket on a railcar without removal of the bracket, and the hook is configured to be removable from the telescoping bar.

In an embodiment, the telescoping bar comprises a first bar portion, a second bar portion, and a third bar portion, wherein the first bar portion is slidably disposed on a first side of the second bar portion and slides relative to the second bar portion, and the third bar portion is slidably disposed on a second side of the second bar portion and slides relative to the second bar portion.

In an embodiment, the first bar portion is held to the second bar portion via at least one bearing.

In an embodiment, the third bar portion is held to the second bar portion via at least one bearing.

In an embodiment, the hook is removably attached to an end of the first bar portion of the telescoping bar.

In an embodiment, the hook is configured to engage a lifting linkage of a railcar coupler.

In an embodiment, the first bar portion or the third bar portion is held to the second bar portion via at least one bearing, wherein the at least one bearing is held in place by a retaining clip comprising a first plate welded to a first side of the second bar portion, a second plate welded to a second side of the second bar portion, and a third plate extending between the first plate and the second plate, wherein the first, second, and third plates form a space wherein the at least one bearing is held within the space.

In an embodiment, the at least one bearing is made from a thermoplastic or a thermoset material.

In an embodiment, the at least one bearing is a square tube, wherein the first bar portion or the second bar portion slides therethrough.

In an embodiment, the handle comprises a first portion extending roughly perpendicular from the telescoping bar, the handle further having a first straight portion extending from a first bend having a first angle, the handle further having a second straight portion extending from a second bend in the first straight portion having a second angle, the second straight portion extending into a loop forming a first plane that is roughly perpendicular to a second plane formed by the first straight portion and the telescoping bar, the loop extending to a third straight portion that extends back toward the second bend, a third bend extending from the third straight portion having a third angle, the third bend extending into a fourth straight portion, a fourth bend extending from the fourth straight portion having a fourth angle, the fourth bend extending into a fifth straight portion.

In an embodiment, the first angle is approximately 45 degrees from the telescoping bar, wherein the second angle is approximately 45 degrees from the first straight portion, wherein the third angle is approximately 90 degrees from the third straight portion, and the fourth bend is approximately 45 degrees from the fourth straight portion.

In an alternate embodiment of the present invention, a method of using an uncoupling lever apparatus is provided. The method comprises the steps of: providing a railcar uncoupling lever apparatus comprising a telescoping bar having a first end and a second end, a handle on the first end of the telescoping bar, a hook on the second end of the telescoping bar, wherein the handle is configured to thread through a bracket on a railcar without removal of the bracket, and the hook is configured to be removable from the telescoping bar; threading the handle of the railcar uncoupling lever apparatus through a bracket on railcar; removing the hook from the second end of the telescoping bar; disposing the hook onto a lifting linkage of a railcar coupler; and attaching the hook to the second end of the telescoping bar.

In an embodiment, the method further comprises the step of: telescoping the telescoping bar so that the uncoupling lever apparatus extends between the bracket on the railcar through which the handle is threaded and the lifting linkage through which the hook is disposed.

In an embodiment, the telescoping bar comprises a first bar portion, a second bar portion, and a third bar portion, wherein the first bar portion is slidably disposed on a first side of the second bar portion and slides relative to the second bar portion, and the third bar portion is slidably disposed on a second side of the second bar portion and slides relative to the second bar portion.

In an embodiment, the method further comprises the steps of: sliding the first bar relative to the second bar to extend or contract the telescoping bar or sliding the third bar relative to the second bar to extend or contract the telescoping bar.

In an embodiment, the first bar portion or the third bar portion is held to the second bar portion via at least one bearing, wherein the bearing is held in place by a retaining clip comprising a first plate welded to a first side of the second bar portion, a second plate welded to a second side of the second bar portion, and a third plate extending between the first plate and the second plate, wherein the first, second, and third plates form a space wherein the at least one bearing is held within the space.

In an embodiment, the at least one bearing is made from a thermoplastic or a thermoset material.

In an embodiment, the at least one bearing is a square tube and comprises the step of: sliding the first bar portion or the second bar portion through the square tube of the at least one bearing when extending or contracting the telescoping bar.

In an embodiment, the handle comprises a first portion extending roughly perpendicular from the telescoping bar, the handle further having a first straight portion extending from a first bend having a first angle, the handle further having a second straight portion extending from a second bend in the first straight portion having a second angle, the second straight portion extending into a loop forming a first plane that is roughly perpendicular to a second plane formed by the first straight portion and the telescoping bar, the loop extending to a third straight portion that extends back toward the second bend, a third bend extending from the third straight portion having a third angle, the third bend extending into a fourth straight portion, a fourth bend extending from the fourth straight portion having a fourth angle, the fourth bend extending into a fifth straight portion.

In an embodiment, the first angle is approximately 45 degrees from the telescoping bar, wherein the second angle is approximately 45 degrees from the first straight portion, wherein the third angle is approximately 90 degrees from the third straight portion, and the fourth bend is approximately 45 degrees from the fourth straight portion.

It is, therefore, an advantage and objective of the present invention to provide improved uncoupling lever apparatuses.

Specifically, it is an advantage and objective of the present invention to provide uncoupling lever apparatuses having longer service lives than typical uncoupling levers.

More specifically, it is an advantage and objective of the present invention to provide uncoupling lever apparatuses comprising improved bearings that resist damage, thereby preventing or minimizing bending or damage of the levers during use in the field.

Moreover, it is an advantage and objective of the present invention to provide improved uncoupling lever apparatuses that are more easily removed and/or installed onto railcars.

More specifically, it is an advantage and objective of the present invention to provide improved uncoupling lever apparatuses that allow a user to remove and/or install the same without removal of the brackets from the railcars, thereby saving time and costs when levers require replacement.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to improved telescoping railcar uncoupling levers. Specifically, the uncoupling levers have improved bearings that resist damage. Moreover, the uncoupling levers include removable lock lifter linkage hooks. In addition, the uncoupling levers comprise an improved handle loop shape allowing the levers to be more easily installed and/or removed when damaged. Methods of using the same are further provided.

Figure 1:
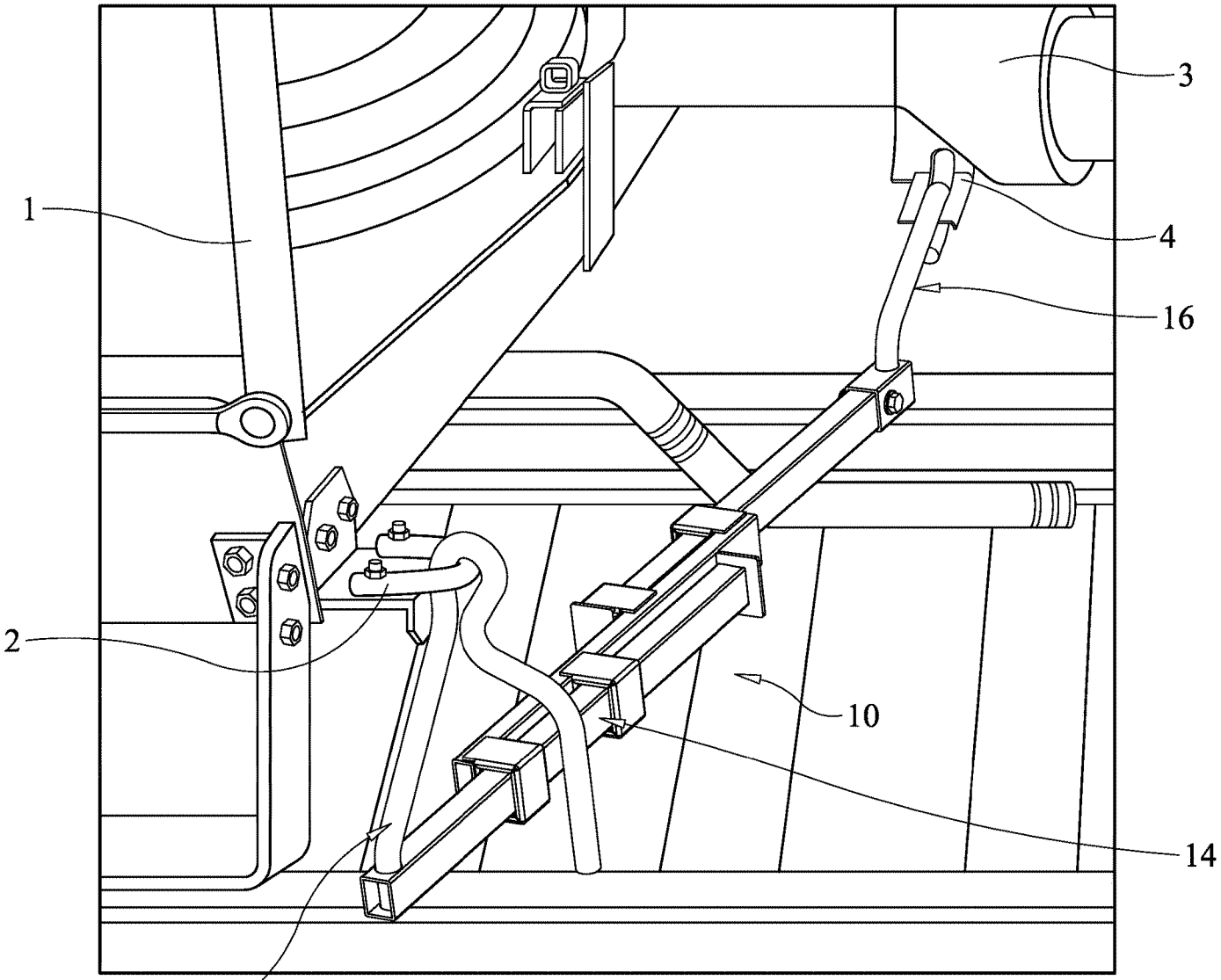
FIG. 1 illustrates a perspective view of a railcar uncoupling lever on a railcar in an embodiment of the present invention.

Referring now to FIG. 1, a railcar uncoupling lever 10 is illustrated in an embodiment of the present invention. The railcar uncoupling lever 10 comprises a handle 12 that is engaged on the end of a railcar 1 via a ring bracket 2. The uncoupling lever 10 generally extends via a telescoping mid portion 14 from the ring bracket 2 on one end thereof to a railcar coupler 3 and is connected to a lifting linkage 4 via a hook 16 on an opposite end of the uncoupling lever 10 from the handle 12. In use, a user lifts or rotates the handle 12 of the uncoupling lever 10, which subsequently lifts the hook 16, which lifts the lifting linkage 4, thereby opening the railcar coupler 3 and allowing the railcar to disengage from an adjacent railcar.

Figure 2A:
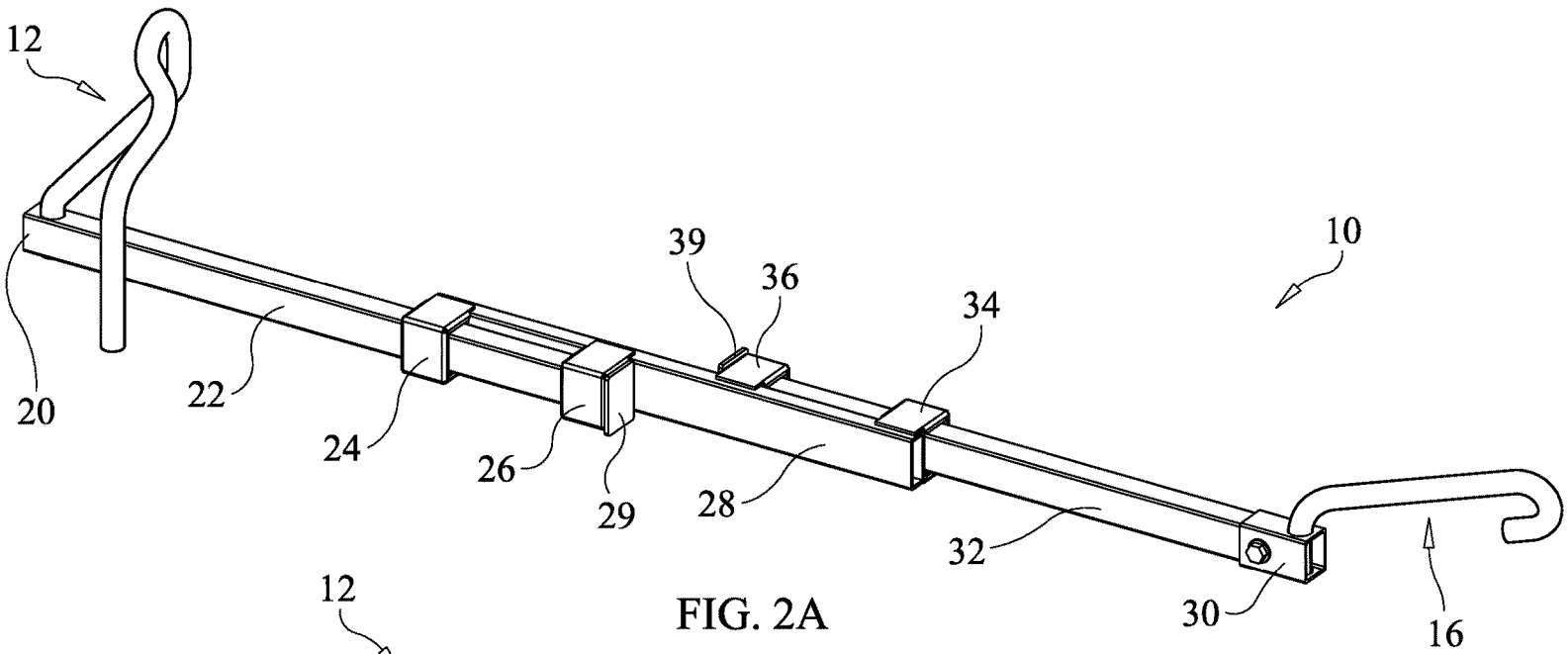
FIGS. 2A-2B illustrate expanded and collapsed views, respectively, of a railcar uncoupling lever in an embodiment of the present invention.
Figure 2B:
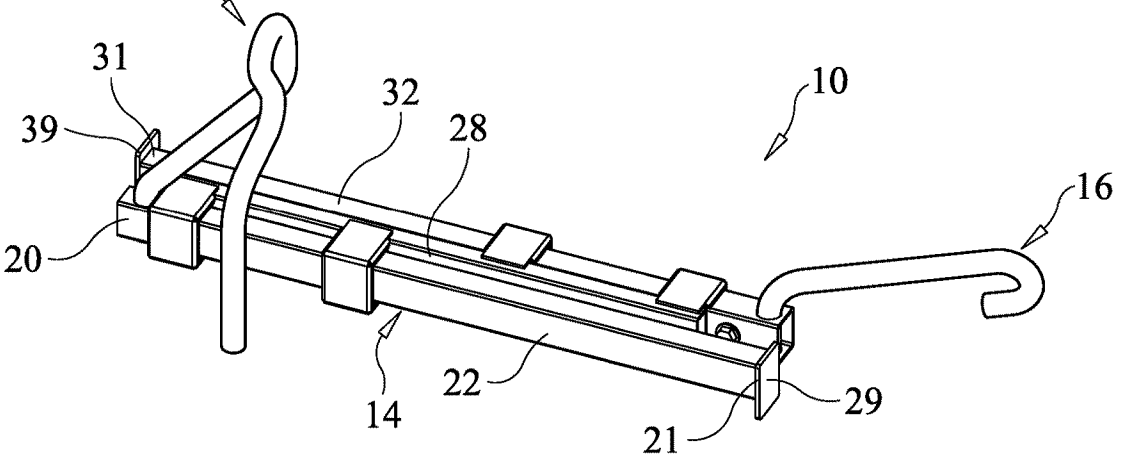

FIGS. 2A and 2B illustrate the railcar uncoupling lever 10 in an extended configuration (FIG. 2A) and in a collapsed or contracted configuration (FIG. 2B). Generally, the handle 12 may extend from a first end 20 of a first bar 22, and may extend through first and second bearings 24, 26, respectively, which may allow the first bar 22 to slide therethrough. The bearings 24, 26 may be held via retaining clips, as described in more detail below with reference to FIG. 7, to a central bar 28 on a first side thereof. A cap or plate 29 may be attached to an opposite end 21 of the first bar 22 to prevent the first bar 22 from sliding completely through the first and second bearings 24, 26.

The hook 16 may be attached on a first end 30 of a second bar 32, and may extend through third and fourth bearings 34, 36, respectively, which may allow the second bar 32 to slide therethrough. The bearings 34, 36 may be held via retaining clips, as described in more detail below, to the central bar 28 on a second side thereof. A cap or plate 39 may be attached to a second end 31 of the second bar 32 and act as a stopper to prevent the second bar 32 from sliding completely through the third and fourth bearings 34, 36.

Thus, both the first bar 22 having the handle 12 thereon and the second bar 32 having the hook 16 thereon may slide relative to the central bar 28, thereby telescoping between an extended configuration, as illustrated in FIG. 2A, and a collapsed or contracted configuration, as illustrated in FIG. 2B.

Figure 6:
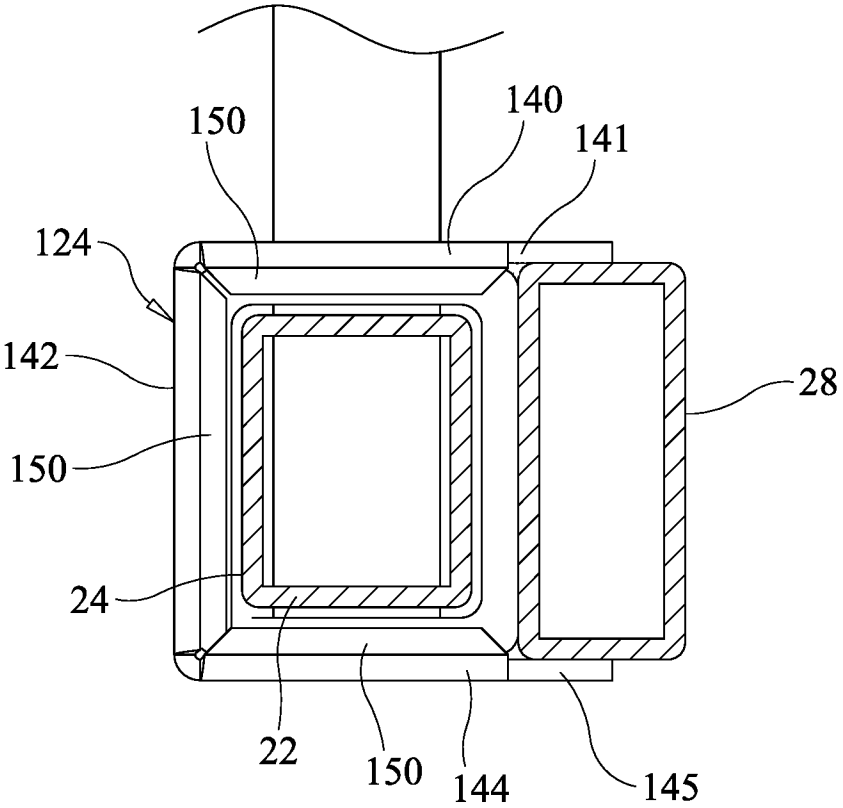
FIG. 6 illustrates a cross-sectional view along lines VI-VI of FIG. 4 of a railcar uncoupling lever in an embodiment of the present invention.
Figure 7:
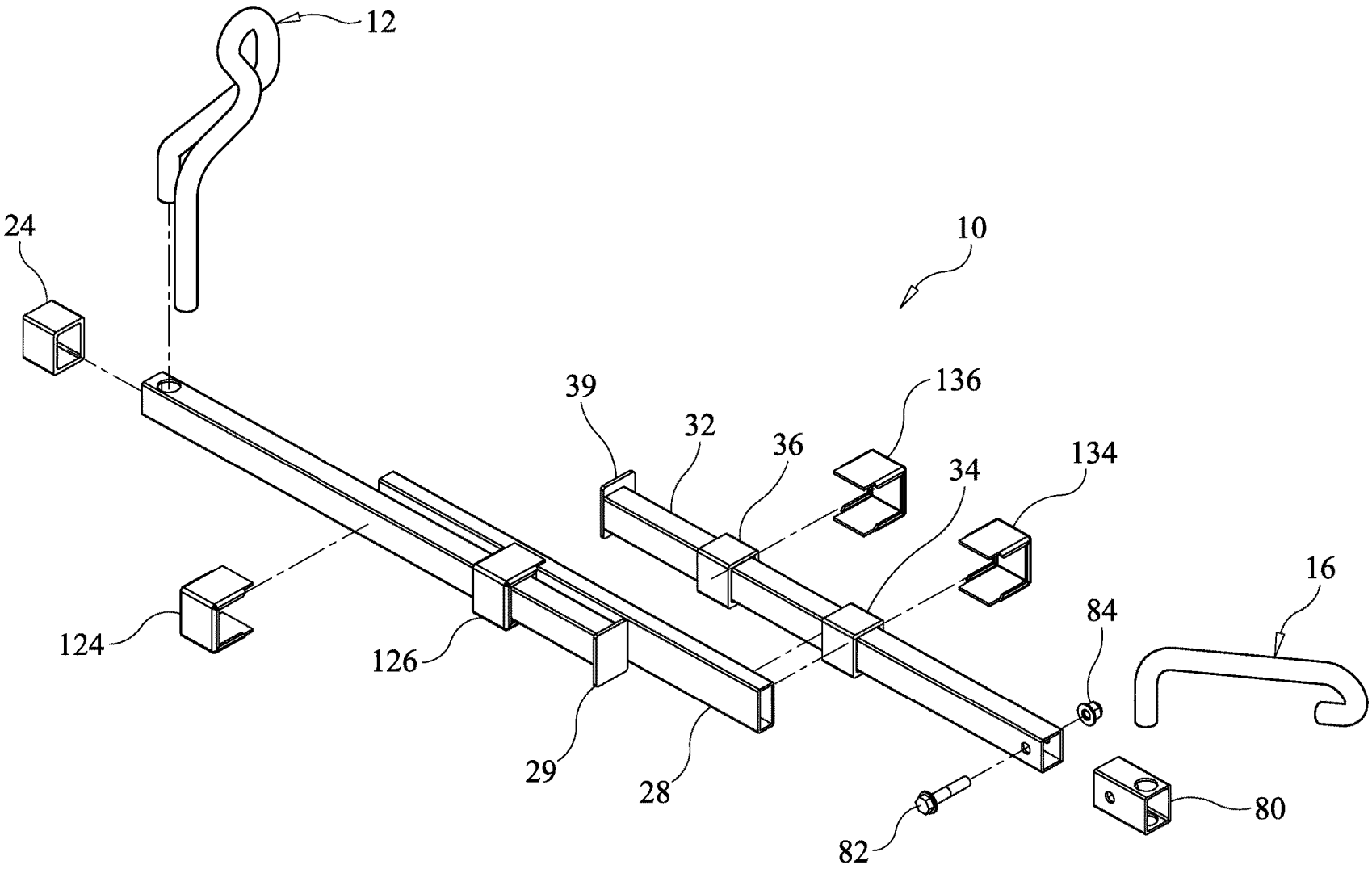
FIG. 7 illustrates an exploded view of a railcar uncoupling lever in an embodiment of the present invention.

FIGS. 6 and 7 illustrate how the bearings 24, 26, 34, 36 are disposed over the first and second bars 22, 32, respectively, and allow the first and second bars 22, 32 to slide therethrough. Specifically, as shown in FIG. 7, the bearings 24, 26, 34, 36 may each be a square tube of slidable material, such as a thermoplastic or thermoset material that may allow the first and second bars 22, 32 to slide therethrough relatively freely. The bearings are held in a fixed relative position to the central bar 28 via clips 124, 126, 134, 136 that may be disposed over the bearings 24, 26, 34, 36, respectively, and welded to the central bar 28.

Figure 4:
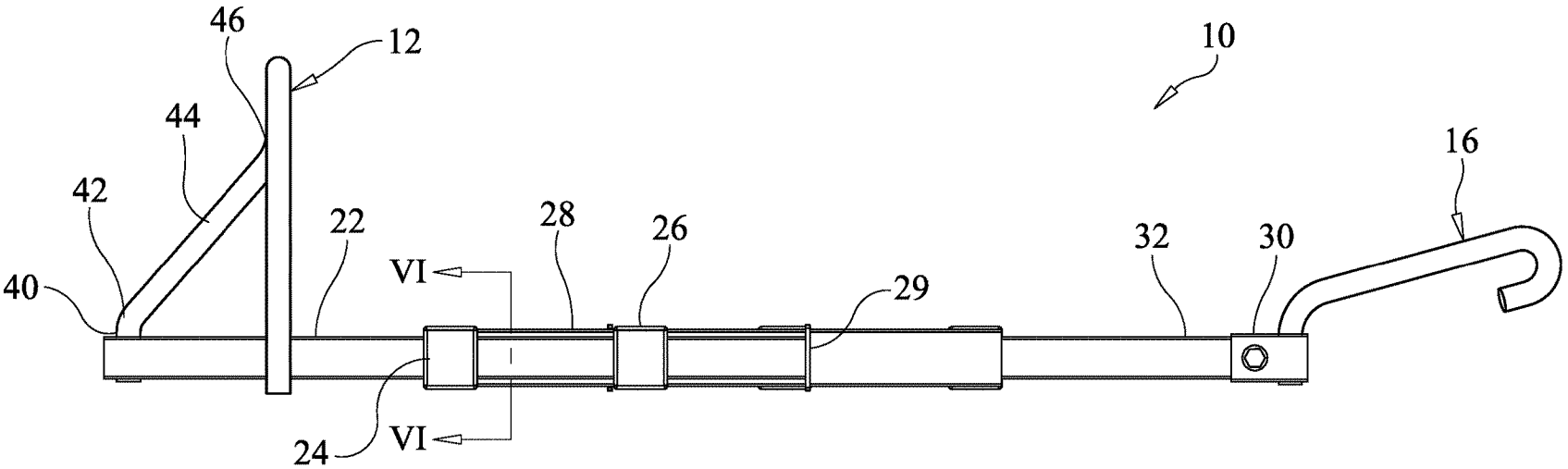
FIG. 4 illustrates a front view of a railcar uncoupling lever in an embodiment of the present invention.

As shown in FIG. 6, which is a cross-sectional view of the uncoupling lever 10 along lines VI-VI of FIG. 4, retaining clip 124 is illustrated. The retaining clip may have a top face 140, a side face 142, and a bottom face 144, each of the faces having tabs 150 on opposite sides thereof extending inwardly, wherein the tabs 150 generally hold the bearing 24 in place prevent the bearing 24 from moving relative to the central bar 28. The top face 140 may have an extension element 141 that may extend over and may be welded to the central bar 28 on a top thereof, whereas the bottom face 144 may have an extension element 145 that may extend over and may be welded to the central bar 28 on a bottom thereof. Thus, the retaining clips 124, 126, 134, 136 may hold each of the respective bearings 24, 26, 34, 36 in place relative to the central bar 28 and prevent them from sliding along the first and second bars 22, 32. Because the retaining clips encapsulate each of the bearings 24, 26, 34, 36, the bearings may be relatively more resilient and remain in place after continued use of the uncoupling lever 10.

Although the bearings 24, 26, 34, 36 are shown as square tubes in the embodiments herein, it should be noted that the bearings may conform to the shape of the tubes on which they are disposed. For example, the first and second bars 22, 32 may be round in cross-section rather than rectangular or square in cross-section, and therefore the bearings 24, 26, 34, 36 may also be round. The bearings may also be roller bearings, having rolling balls or wheels therein to aid in moving the first and second bars 22, 32 therethrough.

Figure 3:
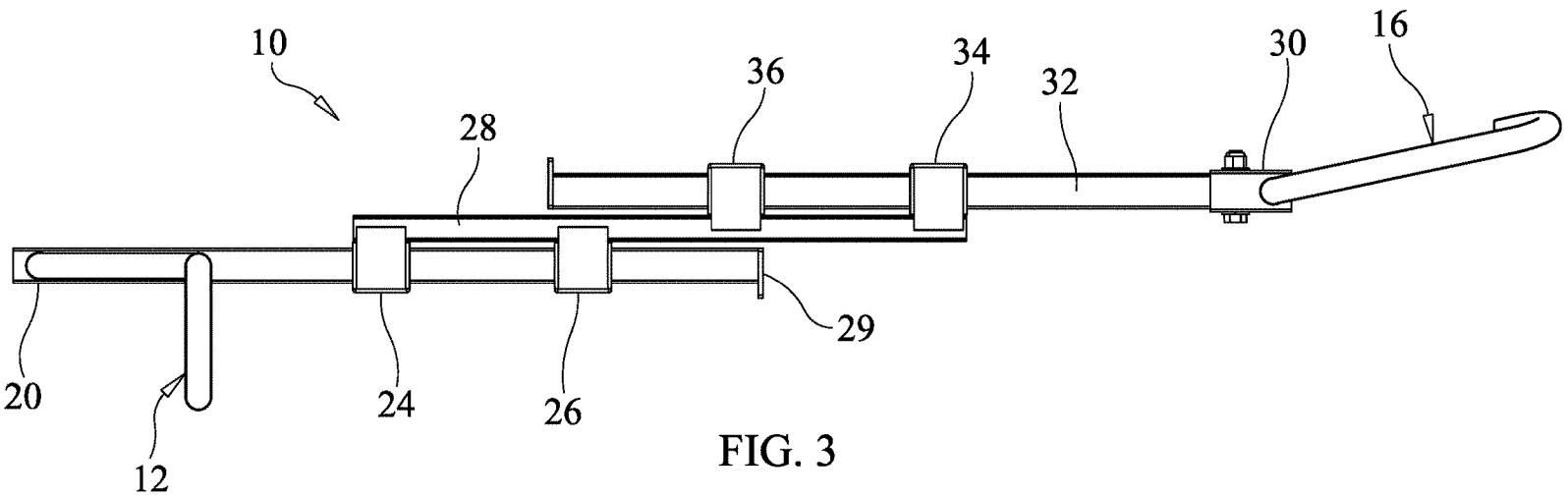
FIG. 3 illustrates a top view of a railcar uncoupling lever in an embodiment of the present invention.
Figure 5:
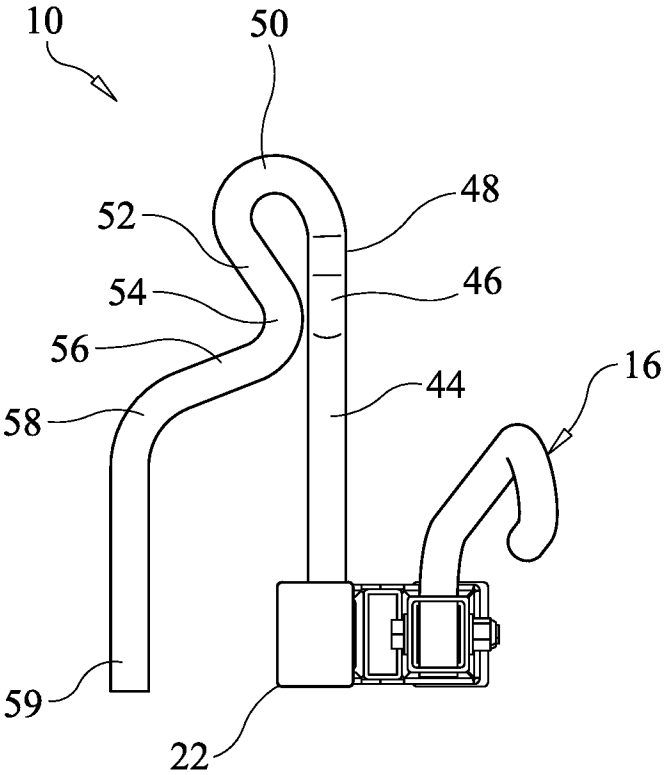
FIG. 5 illustrates a side view of a railcar uncoupling lever in an embodiment of the present invention.

Referring now to FIGS. 3-5, various views of the uncoupling lever are shown, mainly to illustrate the arrangement and configuration of the handle 12. As illustrated, the handle 12 may extend from the first end 20 of the first bar 22. The handle 12 may comprise a first vertical portion 40 that may be welded to the first bar 22, or otherwise extend through the first bar 22 and be welded thereto to rigidly hold the first vertical portion 40. The first vertical portion may have a first bend 42 so that a first straight portion 44 extends at roughly a 135-degree angle from the first vertical portion 40, or 45 degrees relative to the central bar 28. The first straight portion 44 may have a second bend 46 forming a second vertical portion 48 extending from the first straight portion at roughly a 45-degree angle relative to the first straight portion 44. The second vertical portion 48 may extend into a loop 50 forming a plane that is roughly perpendicular to a plane formed by the first straight portion 44 and the central bar 28. The loop 50 may extend to a third straight portion 52 that extends back toward the second bend 46 within the second plane and may form a third bend 54 that extends into a fourth straight portion 56 from the third bend at roughly 90 degrees relative to the third straight portion 52 that, in turn, extends into a fourth bend 58 that extends into a third vertical portion 59, wherein the third vertical portion 59 extends at roughly 45 degrees relative to the fourth straight portion 54 at the fourth bend 58.

A user may utilize the configuration and arrangement of the handle 12 to allow the handle to be placed into the bracket 2 of the railcar 1, as illustrated in FIG. 1. Specifically, the uncoupling lever 10 may be turned upside down so that the third vertical portion 59 may be threaded through the bracket 2, wherein the various bends, vertical portions, and straight portions, may traverse through the bracket 2 until the uncoupling lever 10 is turned right side up as shown in FIG. 1. The uncoupling lever 10 may be removed from the bracket 2 by threading the handle 12 therethrough in reverse to the steps disclosed above.

To aid in the installation and/or removal of the uncoupling lever 10, the hook 16 may be removable from the second bar 32. Removing the hook 16 allows a user to handle and manipulate the remainder of the uncoupling lever 10 in an easier and more efficient manner, without the hook making it difficult to maneuver the same due to the low clearance near the coupler.

FIGS. 8-11 illustrate embodiments of the removable hook 16, showing two alternate configurations. It should be noted that although the present invention discloses two alternate configurations, there may be other configurations not shown herein and the present invention should not be limited as disclosed herein.

Figure 8:
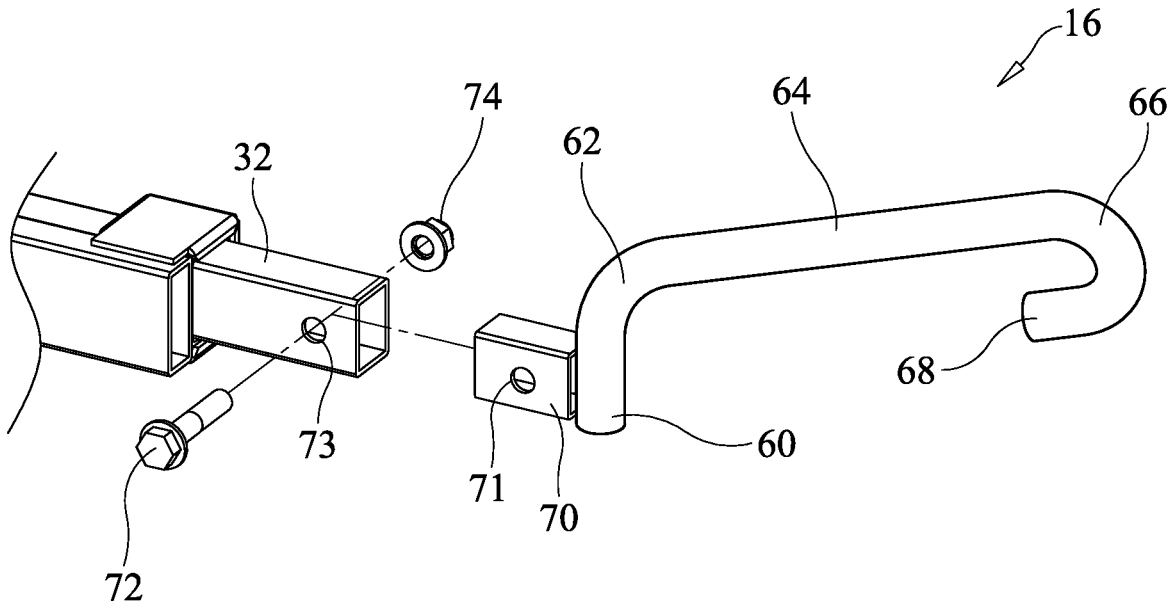
FIG. 8 illustrates a close-up exploded view of a hook of a railcar uncoupling lever in an embodiment of the present invention.
Figure 9:
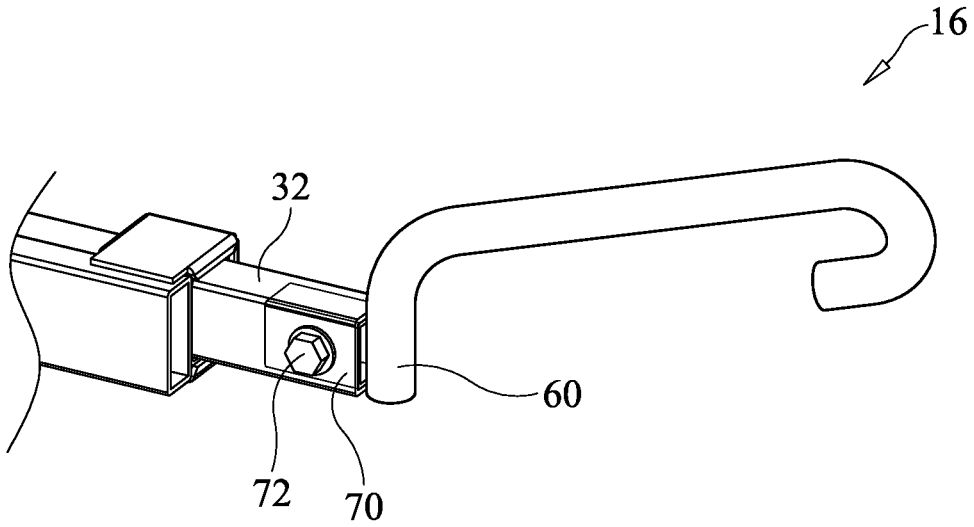
FIG. 9 illustrates a close-up view of a hook of a railcar uncoupling lever in an embodiment of the present invention.

FIGS. 8-9 illustrate a first hook configuration, showing the hook 16 having a first vertical element 60 having a first bend 62 extending into a first straight portion 64 which may extend at a greater than 90-degree angle relative to the first vertical element 60. The first straight portion 64 may extend to a roughly 180-degree bend 66 terminating in a second straight portion 68. The configuration of the hook 16 may allow the same to be engaged with the lifting linkage of the Janney-type coupler, thereby allowing the coupler to be uncoupled when the uncoupling lever 10 is lifted or rotated via the handle 12.

The first vertical portion 60 may be welded to an insert tube 70 having an aperture 71 therethrough. As shown in FIGS. 8 and 9, the insert tube 70 may be inserted into the second bar 32 and secured via a bolt 72 and nut 74 through an aperture 73 within the second bar and the aperture 71 within the insert tube 70.

Figure 10:
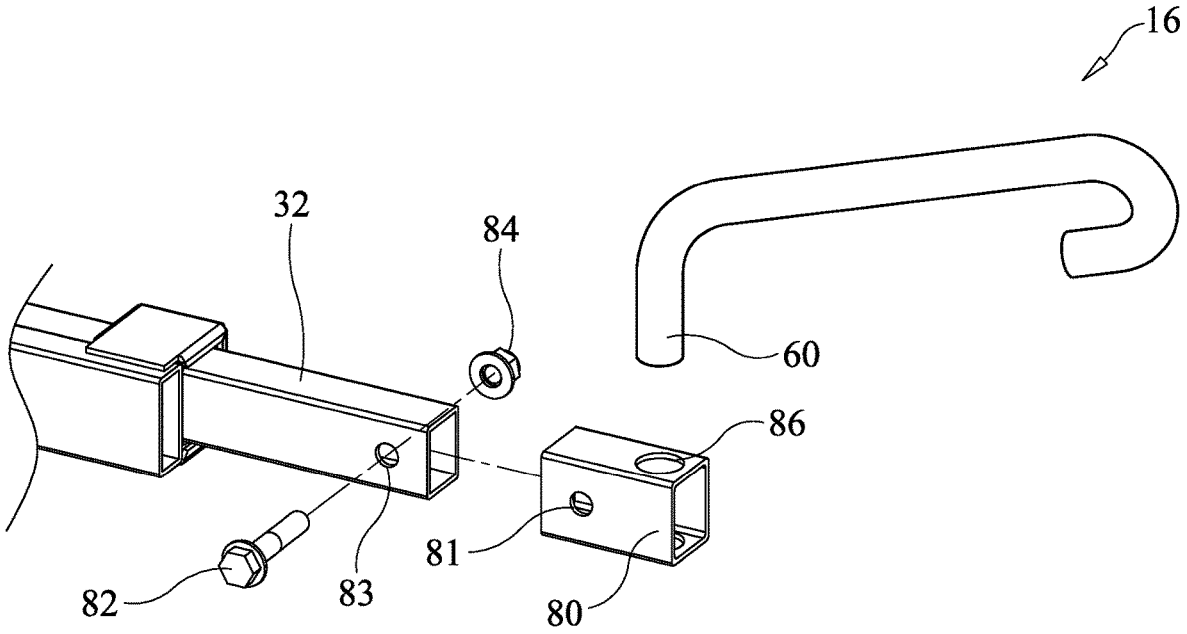
FIG. 10 illustrate a close-up exploded view of a hook of a railcar uncoupling lever in an alternate embodiment of the present invention.
Figure 11:
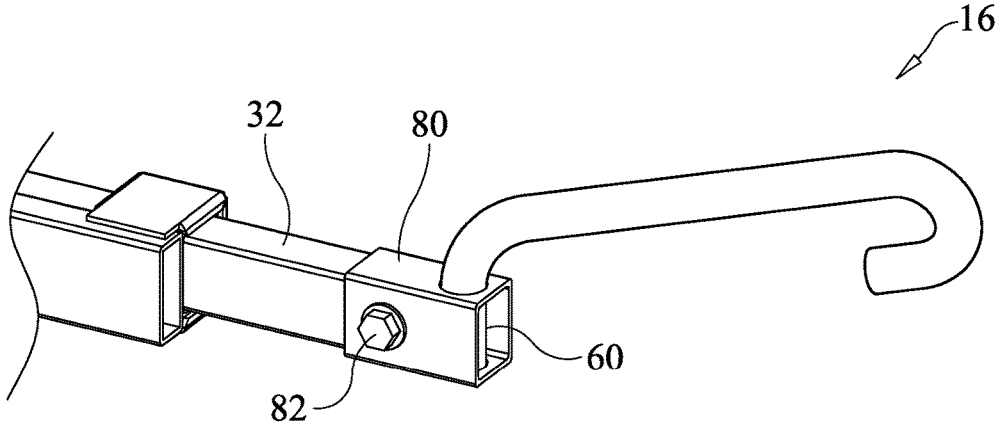
FIG. 11 illustrates a close-up view of a hook of a railcar uncoupling lever in an alternate embodiment of the present invention.

In an alternate embodiment, illustrated in FIG. 10-11, the first vertical portion 60 may be inserted into a passage 86 within a tube extension 80 and welded therein for additional strength. The tube extension 80 may further have an aperture 81 therein. As shown in FIGS. 10-11, the tube extension 80 may be disposed over the second bar 32, which may have an aperture 83 therein so that a bolt 82 may extend through the aperture 81 within the tube extension 80 and the aperture 83 and secured with a nut 84.

Thus, when installed between a railcar ring bracket and a lifting linkage of a coupler, the hook 16 may be removed from the lever apparatus 10, the handle may be threaded into and through the ring bracket of the railcar, as described above, and the hook 16 may be reattached thereto and connected to the lifting linkage of the coupler. Therefore, the lever apparatus 10 may be installed and/or removed without removal of the ring bracket. Moreover, handling and manual manipulation of the lever apparatus 10 may be easier than heretofore known, even with the space constraints between adjacent railcars and beneath the coupler.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A railcar uncoupling lever apparatus comprising:

a telescoping bar having a first end and a second end;

a handle on the first end of the telescoping bar;

a hook on the second end of the telescoping bar;

wherein the handle is configured to thread through a bracket on a railcar without removal of the bracket, and the hook is configured to be removable from the telescoping bar, wherein the telescoping bar comprises a first bar portion, a second bar portion, and a third bar portion, wherein the first bar portion is slidably disposed on a first side of the second bar portion and slides relative to the second bar portion, and the third bar portion is slidably disposed on a second side of the second bar portion and slides relative to the second bar portion, wherein the first bar portion or the third bar portion is held to the second bar portion via at least one bearing, wherein the at least one bearing is held in place by a retaining clip comprising a first plate welded to a first side of the second bar portion, a second plate welded to a second side of the second bar portion, and a third plate extending between the first plate and the second plate, wherein the first, second, and third plates form a space wherein the at least one bearing is held within the space.

2. The railcar uncoupling lever apparatus of claim 1 wherein the first bar portion is held to the second bar portion via at least one bearing.

3. The railcar uncoupling lever apparatus of claim 1 wherein the third bar portion is held to the second bar portion via at least one bearing.

4. The railcar uncoupling lever apparatus of claim 1 wherein the hook is removably attached to an end of the first bar portion of the telescoping bar.

5. The railcar uncoupling lever apparatus of claim 1 wherein the hook is configured to engage a lifting linkage of a railcar coupler.

6. The railcar uncoupling lever apparatus of claim 1 wherein the at least one bearing is made from a thermoplastic or a thermoset material.

7. The railcar uncoupling lever apparatus of claim 1 wherein the at least one bearing is a square tube, wherein the first bar portion or the second bar portion slides therethrough.

8. The railcar uncoupling lever apparatus of claim 1 wherein the handle comprises a first portion extending perpendicular from the telescoping bar, the handle further having a first straight portion extending from a first bend having a first angle, the handle further having a second straight portion extending from a second bend in the first straight portion having a second angle, the second straight portion extending into a loop forming a first plane that is perpendicular to a second plane formed by the first straight portion and the telescoping bar, the loop extending to a third straight portion that extends back toward the second bend, a third bend extending from the third straight portion having a third angle, the third bend extending into a fourth straight portion, a fourth bend extending from the fourth straight portion having a fourth angle, the fourth bend extending into a fifth straight portion.

9. The railcar uncoupling lever apparatus of claim 8 wherein the first angle is approximately 45 degrees from the telescoping bar, wherein the second angle is approximately 45 degrees from the first straight portion, wherein the third angle is approximately 90 degrees from the third straight portion, and the fourth bend is approximately 45 degrees from the fourth straight portion.

10. A method of using an uncoupling lever apparatus comprising the steps of:

providing a railcar uncoupling lever apparatus comprising a telescoping bar having a first end and a second end, a handle on the first end of the telescoping bar, a hook on the second end of the telescoping bar, wherein the handle is configured to thread through a bracket on a railcar without removal of the bracket, and the hook is configured to be removable from the telescoping bar;

threading the handle of the railcar uncoupling lever apparatus through a bracket on railcar;

removing the hook from the second end of the telescoping bar;

disposing the hook onto a lifting linkage of a railcar coupler; and attaching the hook to the second end of the telescoping bar.

11. The method of claim 10 further comprising the step of:

telescoping the telescoping bar so that the uncoupling lever apparatus extends between the bracket on the railcar through which the handle is threaded and the lifting linkage through which the hook is disposed.

12. The method of claim 10 wherein the telescoping bar comprises a first bar portion, a second bar portion, and a third bar portion, wherein the first bar portion is slidably disposed on a first side of the second bar portion and slides relative to the second bar portion, and the third bar portion is slidably disposed on a second side of the second bar portion and slides relative to the second bar portion.

13. The method of claim 12 further comprising the steps of:

sliding the first bar relative to the second bar to extend or contract the telescoping bar or sliding the third bar relative to the second bar to extend or contract the telescoping bar.

14. The method of claim 12 wherein the first bar portion or the third bar portion is held to the second bar portion via at least one bearing, wherein the bearing is held in place by a retaining clip comprising a first plate welded to a first side of the second bar portion, a second plate welded to a second side of the second bar portion, and a third plate extending between the first plate and the second plate, wherein the first, second, and third plates form a space wherein the at least one bearing is held within the space.

15. The method of claim 14 wherein the at least one bearing is made from a thermoplastic or a thermoset material.

16. The method of claim 14 wherein the at least one bearing is a square tube and comprising the step of:

sliding the first bar portion or the second bar portion through the square tube of the at least one bearing when extending or contracting the telescoping bar.

17. The method of claim 10 wherein the handle comprises a first portion extending perpendicular from the telescoping bar, the handle further having a first straight portion extending from a first bend having a first angle, the handle further having a second straight portion extending from a second bend in the first straight portion having a second angle, the second straight portion extending into a loop forming a first plane that is perpendicular to a second plane formed by the first straight portion and the telescoping bar, the loop extending to a third straight portion that extends back toward the second bend, a third bend extending from the third straight portion having a third angle, the third bend extending into a fourth straight portion, a fourth bend extending from the fourth straight portion having a fourth angle, the fourth bend extending into a fifth straight portion.

18. The method of claim 17 wherein the first angle is approximately 45 degrees from the telescoping bar, wherein the second angle is approximately 45 degrees from the first straight portion, wherein the third angle is approximately 90 degrees from the third straight portion, and the fourth bend is approximately 45 degrees from the fourth straight portion.

19. A railcar uncoupling lever apparatus comprising:

a telescoping bar having a first end and a second end;

a handle on the first end of the telescoping bar;

a hook on the second end of the telescoping bar;

wherein the handle is configured to thread through a bracket on a railcar without removal of the bracket, and the hook is configured to be removable from the telescoping bar, wherein the handle comprises a first portion extending perpendicular from the telescoping bar, the handle further having a first straight portion extending from a first bend having a first angle, the handle further having a second straight portion extending from a second bend in the first straight portion having a second angle, the second straight portion extending into a loop forming a first plane that is perpendicular to a second plane formed by the first straight portion and the telescoping bar, the loop extending to a third straight portion that extends back toward the second bend, a third bend extending from the third straight portion having a third angle, the third bend extending into a fourth straight portion, a fourth bend extending from the fourth straight portion having a fourth angle, the fourth bend extending into a fifth straight portion.

20. The railcar uncoupling lever apparatus of claim 19 wherein the first angle is approximately 45 degrees from the telescoping bar, wherein the second angle is approximately 45 degrees from the first straight portion, wherein the third angle is approximately 90 degrees from the third straight portion, and the fourth bend is approximately 45 degrees from the fourth straight portion.

* * * * *